US011287216B2

(12) United States Patent
Padovan

(10) Patent No.: US 11,287,216 B2
(45) Date of Patent: Mar. 29, 2022

(54) PISTOL

(71) Applicant: David W. Padovan, South Pasadena, FL (US)

(72) Inventor: David W. Padovan, South Pasadena, FL (US)

( * ) Notice: Subject to any disclaimer, the term of this patent is extended or adjusted under 35 U.S.C. 154(b) by 0 days.

(21) Appl. No.: 17/080,968

(22) Filed: Oct. 27, 2020

(65) Prior Publication Data

US 2021/0131764 A1 May 6, 2021

Related U.S. Application Data

(60) Provisional application No. 62/928,392, filed on Oct. 31, 2019.

(51) Int. Cl.
*F41G 1/02* (2006.01)
*F41C 3/00* (2006.01)

(52) U.S. Cl.
CPC . *F41G 1/02* (2013.01); *F41C 3/00* (2013.01)

(58) Field of Classification Search
CPC ..... F41C 3/00; F41C 23/06; F41G 1/02
USPC ..... 42/18
See application file for complete search history.

(56) References Cited

U.S. PATENT DOCUMENTS 3,365,829 A * 1/1968 Shockey ..... F41C 27/22 42/97
4,127,056 A * 11/1978 Kart ..... F41A 21/484 42/75.02
4,338,740 A * 7/1982 Miller ..... F41G 1/06 42/111
4,584,925 A * 4/1986 Culotta ..... F41A 19/58 102/275
4,691,614 A * 9/1987 Leffel ..... F41A 21/36 89/14.3
4,715,140 A * 12/1987 Rosenwald ..... F41C 27/22 42/97
5,671,561 A * 9/1997 Johnson ..... F41G 1/35 42/114
6,116,137 A * 9/2000 Strahan ..... F41A 3/64 42/7
6,185,854 B1 * 2/2001 Solinsky ..... F41G 1/35 362/110

(Continued)

FOREIGN PATENT DOCUMENTS

FR 2860290 A1 * 4/2005 ..... F41G 1/02

*Primary Examiner* — Joshua E Freeman
(74) *Attorney, Agent, or Firm* — Bennet K. Langlotz; Langlotz Patent & Trademark Works, LLC

(57) ABSTRACT

A pistol has a frame having a grip, an elongated slide connected to the frame and operable to reciprocate on the frame between a forward battery position and a rear position, the elongated slide having opposed forward and rear ends, a rear sight connected proximate the rear end of the elongated slide, the frame including a front sight support element at a forward frame end forward of the forward end of the elongated slide when the elongated slide is in the forward battery position, and the front sight support element including a front sight operably registered with the rear sight when the elongated slide is in the forward battery position. The elongated slide may define a passage receiving a barrel defining a muzzle aperture, and wherein the front sight support element defines an opening registered with the muzzle aperture.

9 Claims, 8 Drawing Sheets

(56) References Cited

U.S. PATENT DOCUMENTS

| | | | | |
|---|---|---|---|---|
| 7,194,836 | B1 * | 3/2007 | Urban | F41C 27/22 42/106 |
| 7,578,090 | B1 * | 8/2009 | Romaszka | F41C 27/16 42/85 |
| 8,132,352 | B2 * | 3/2012 | Lippard | F41A 21/325 42/111 |
| 8,584,390 | B1 * | 11/2013 | Fraher | F41C 23/10 42/71.02 |
| D716,397 | S * | 10/2014 | Rothmann | D22/104 |
| D716,899 | S * | 11/2014 | Rothmann | D22/104 |
| 9,470,480 | B2 * | 10/2016 | Kirchhoff | F41G 11/001 |
| 9,644,909 | B2 * | 5/2017 | Hangen | F41A 3/86 |
| 9,651,337 | B1 * | 5/2017 | Curry | F41C 3/00 |
| 9,797,687 | B2 * | 10/2017 | Zimmer | F41G 11/001 |
| 9,939,224 | B2 * | 4/2018 | Fischer | F41A 21/325 |
| 9,970,727 | B2 * | 5/2018 | Niswander | F41A 21/36 |
| 10,180,300 | B2 * | 1/2019 | Schirmer | F41A 21/28 |
| 10,788,286 | B2 * | 9/2020 | Molina | F41A 35/02 |
| 10,941,998 | B1 * | 3/2021 | Fan | F41A 21/36 |
| 2015/0247697 | A1 * | 9/2015 | Hangen | F41A 9/64 42/1.06 |
| 2015/0330736 | A1 * | 11/2015 | Love | F41C 3/00 42/16 |
| 2018/0347926 | A1 * | 12/2018 | Lopatin | F41A 3/26 |
| 2018/0347933 | A1 * | 12/2018 | Molina | F41A 21/44 |

* cited by examiner

PISTOL

CROSS-REFERENCE TO RELATED APPLICATION

This application claims the benefit of U.S. Provisional Patent Application No. 62/928,392 filed on Oct. 31, 2019, entitled "HANDGUN TOMBFRAME RECEIVER," which is hereby incorporated by reference in its entirety for all that is taught and disclosed therein.

FIELD OF THE INVENTION

The present invention relates to firearms, and more particularly to a pistol that provides a front sight that remains stationary with respect to the frame during firearm operation.

BACKGROUND OF THE INVENTION

Numerous prior art examples exist of pistols that include front sights to enable fast target acquisition for an initial shot and aimed follow up shots. Semi-automatic pistols conventionally locate front sights on the slide. While this has the advantage of making the front sight easy for the user to see, it has the considerable disadvantage of the front sight reciprocating rearwardly and forwardly as the firearm cycles after discharge. As a result, the user must wait to reacquire the target to aim a follow up shot until the slide has completely returned from recoil because the front sight is out of position during recoil. The slide may also lock up variably, which can cause the front sight position to be slightly variable, potentially adversely affecting the pistol's accuracy.

Therefore, a need exists for a new and improved pistol that enables a front sight to remain stationary with respect to the frame during firearm operation. In this regard, the various embodiments of the present invention substantially fulfill at least some of these needs. In this respect, the pistol according to the present invention substantially departs from the conventional concepts and designs of the prior art, and in doing so provides an apparatus primarily developed for the purpose of enabling a front sight to remain stationary with respect to the frame during firearm operation.

SUMMARY OF THE INVENTION

The present invention provides an improved pistol, and overcomes the above-mentioned disadvantages and drawbacks of the prior art. As such, the general purpose of the present invention, which will be described subsequently in greater detail, is to provide an improved pistol that has all the advantages of the prior art mentioned above.

To attain this, the preferred embodiment of the present invention essentially comprises a frame having a grip, an elongated slide connected to the frame and operable to reciprocate on the frame between a forward battery position and a rear position, the elongated slide having opposed forward and rear ends, a rear sight connected proximate the rear end of the elongated slide, the frame including a front sight support element at a forward frame end forward of the forward end of the elongated slide when the elongated slide is in the forward battery position, and the front sight support element including a front sight operably registered with the rear sight when the elongated slide is in the forward battery position. The elongated slide may define a passage receiving a barrel defining a muzzle aperture, and wherein the front sight support element defines an opening registered with the muzzle aperture. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
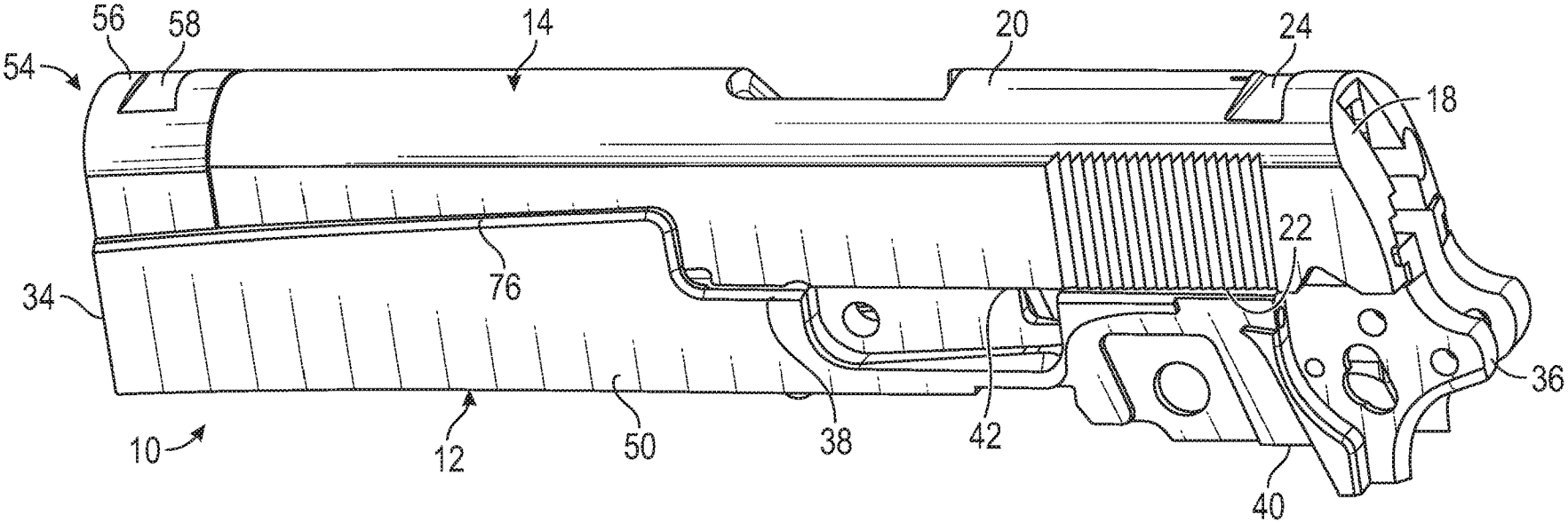
FIG. 1 is a top isometric view of the current embodiment of a frame constructed in accordance with the principles of the present invention showing an attached slide with the action in the closed/forward battery position.

An embodiment of the pistol of the present invention is shown and generally designated by the reference numeral 10.

Figure 2:
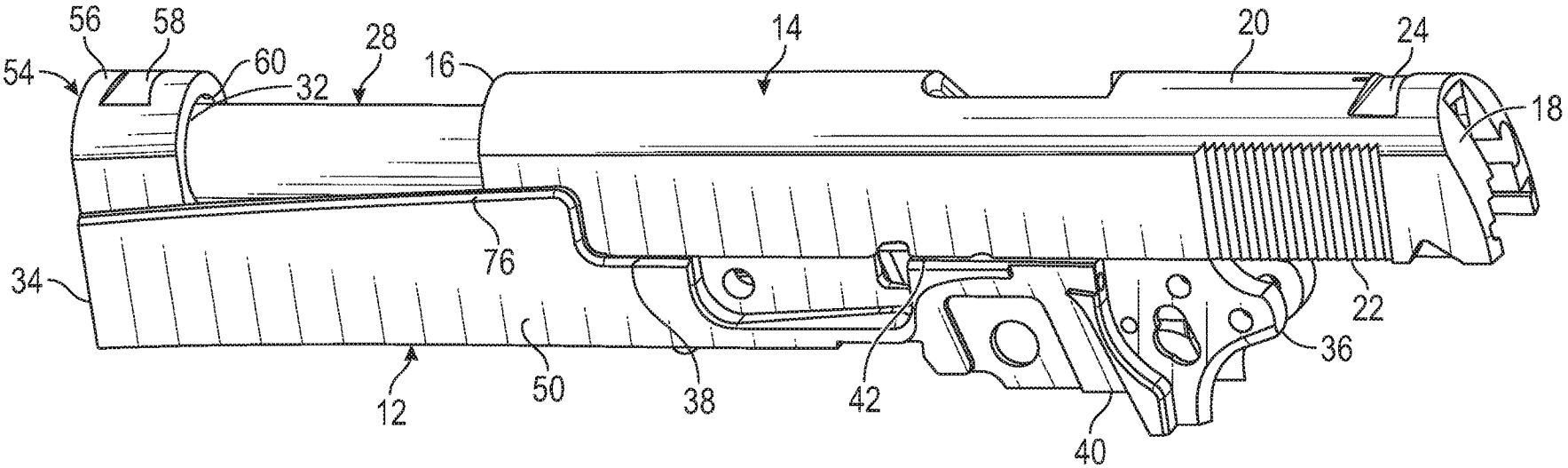
FIG. 2 is a top isometric view of the frame of FIG. 1 showing an attached slide with the action in the open/rear position.
Figure 3:
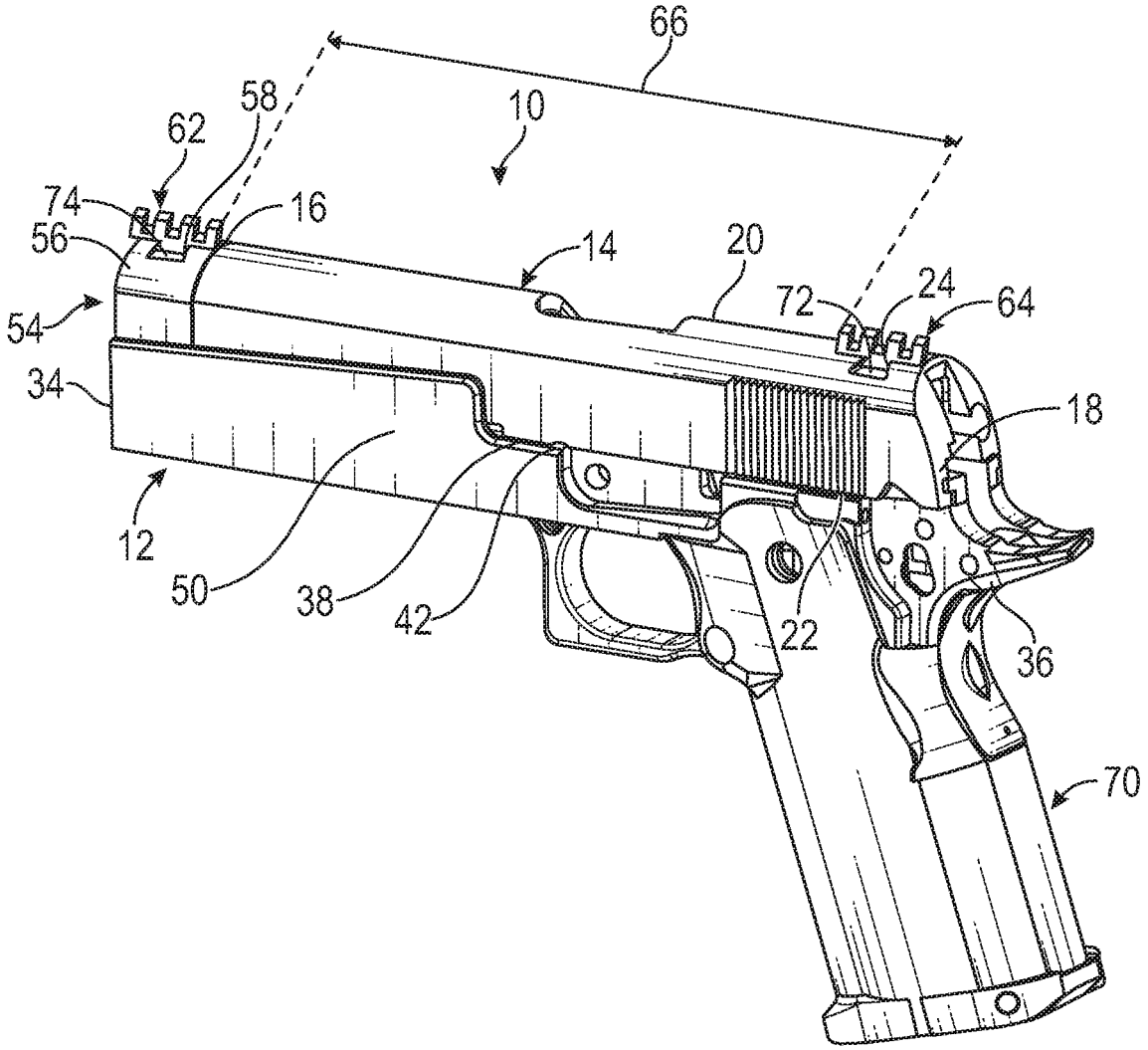
FIG. 3 is a top isometric view of a pistol constructed in accordance with the principles of the present invention including the frame of FIG. 1 with the action in the closed/forward battery position.
Figure 4:
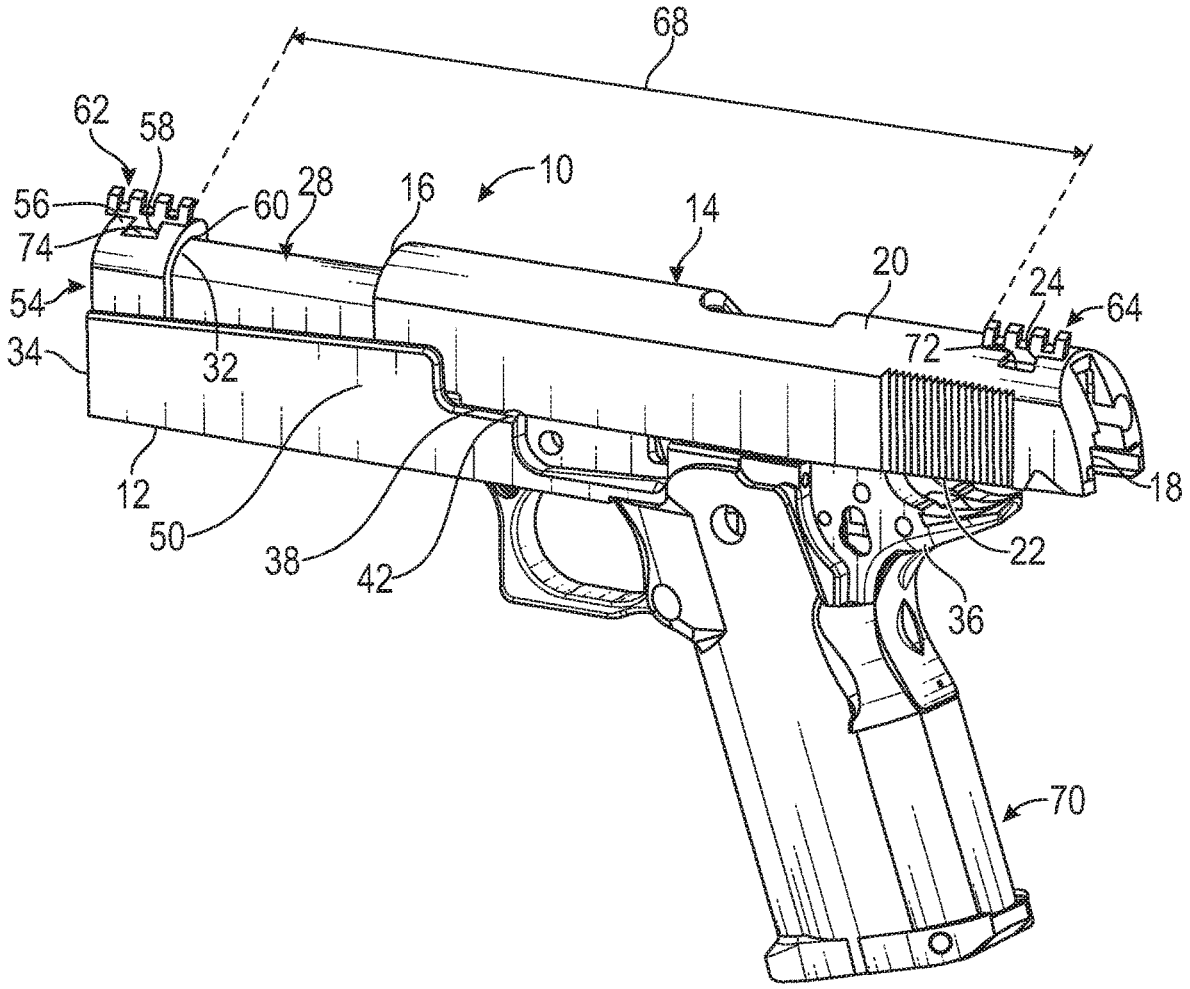
FIG. 4 is a top isometric view of the pistol of FIG. 3 with the action in the open/rear position.
Figure 5:
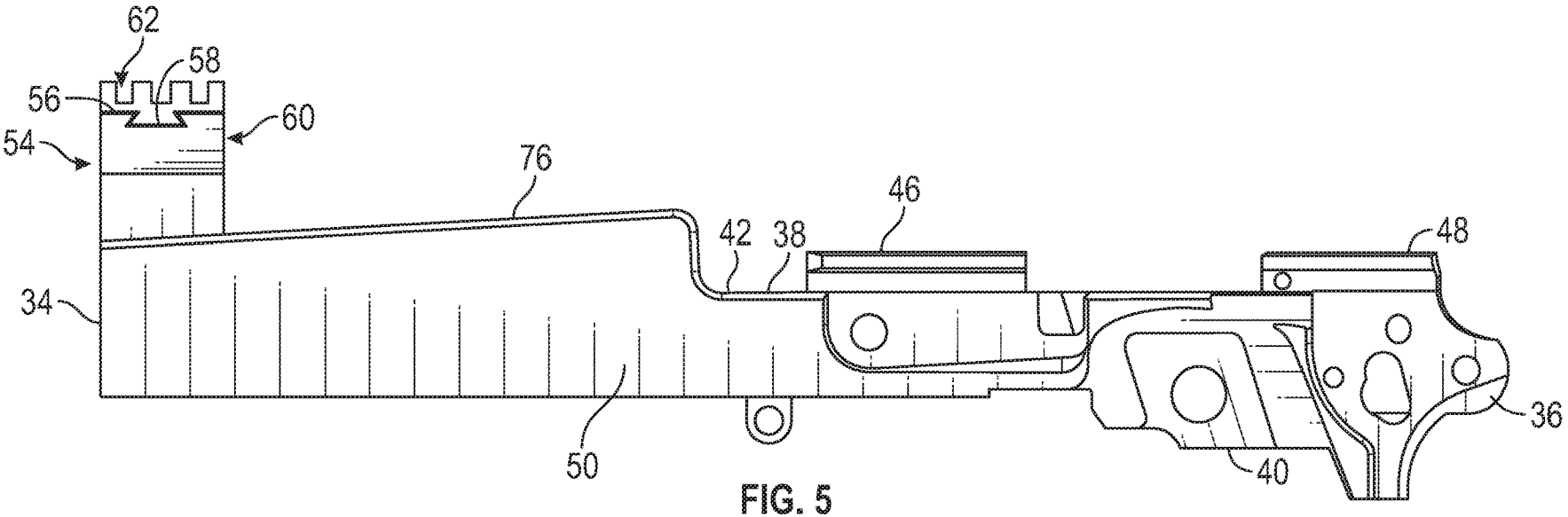
FIG. 5 is a side view of the frame of FIG. 1.
Figure 6:
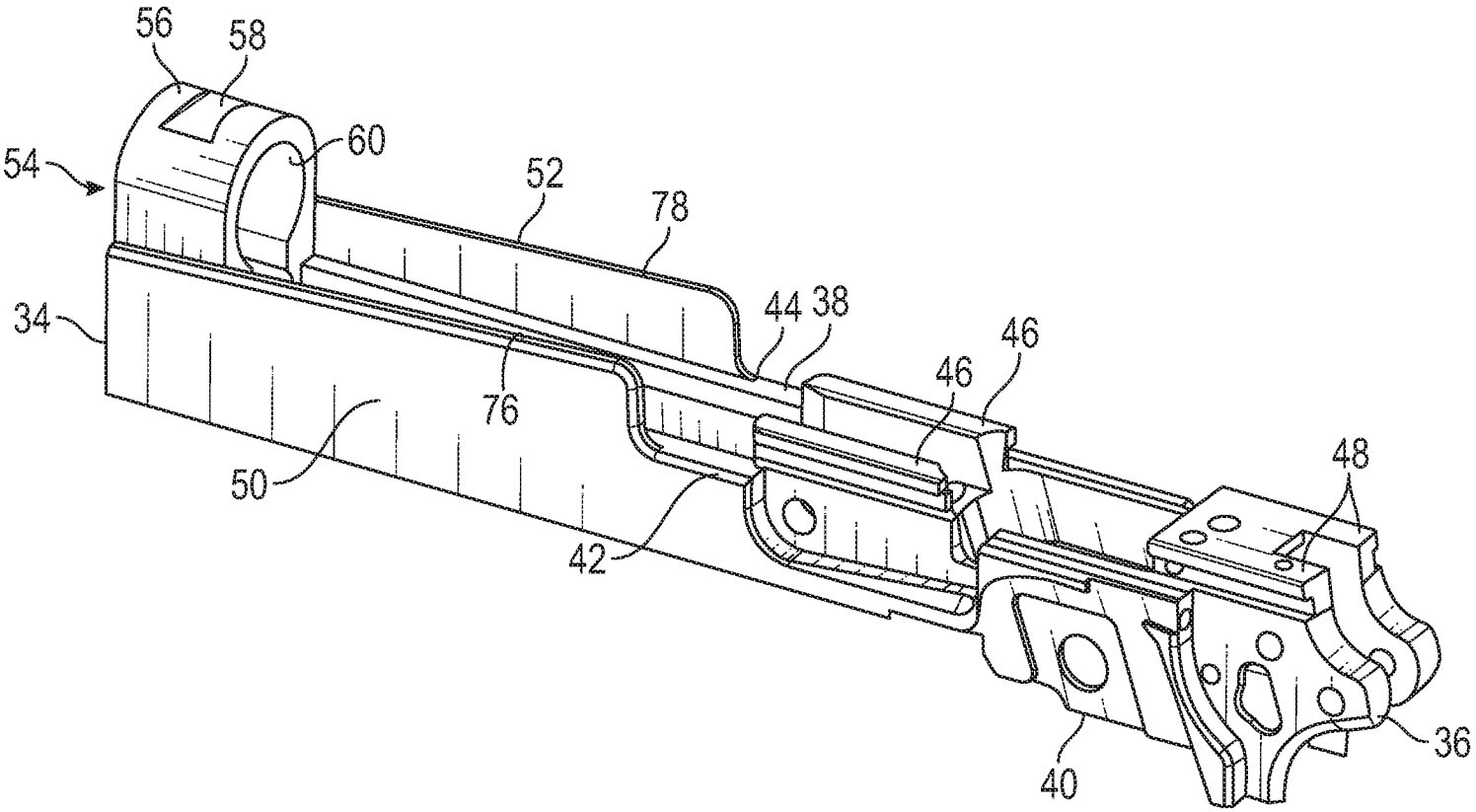
FIG. 6 is a top isometric view of the frame of FIG. 1.
Figure 7:
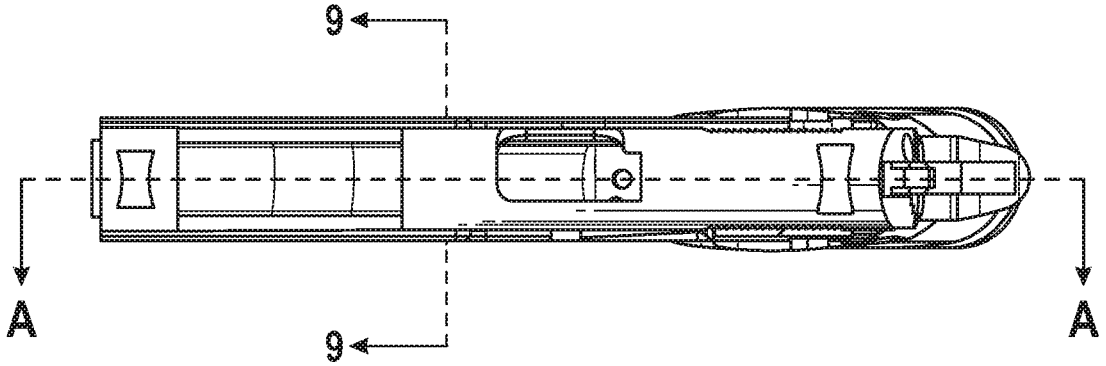
FIG. 7 is a side sectional view of the pistol of FIG. 3 with the action in the closed/forward battery position.
Figure 7:
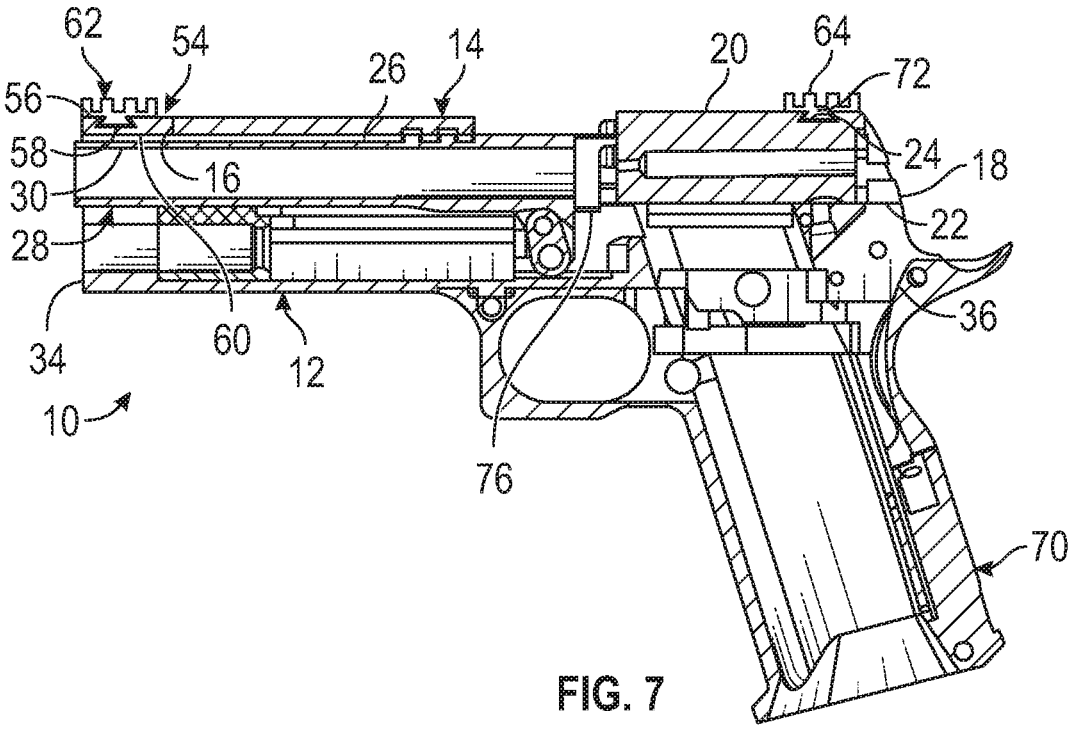
Figure 8:
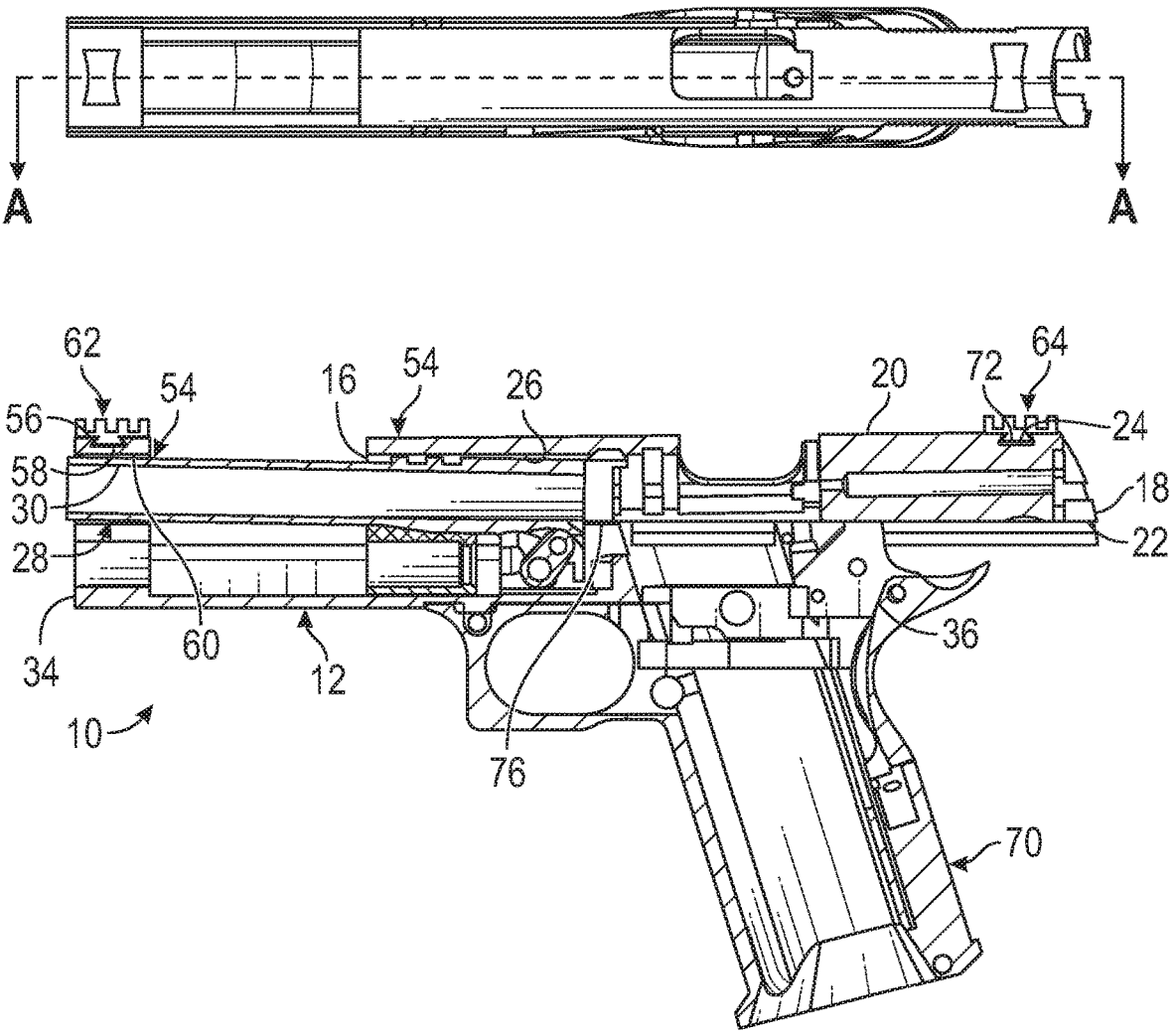
FIG. 8 is a side sectional view of the pistol of FIG. 3 with the action in the open/rear position.
Figure 9:
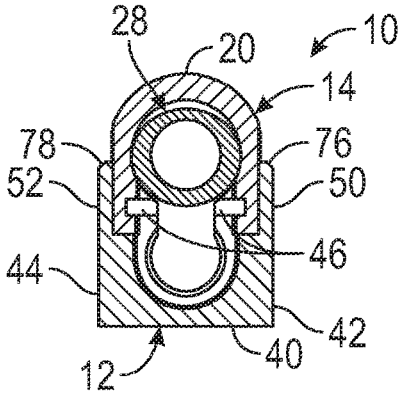
FIG. 9 is a front sectional view of the pistol of FIG. 3 with the action in the closed/forward battery position.

FIGS. 1, 2, 5 & 6 illustrate the improved frame 12 of the present invention, and FIGS. 3, 4, and 7-9 illustrate the improved pistol 10 of the present invention. More particularly, FIGS. 1, 3, 7, and 9 show the frame with an attached elongated slide 14 with the action in the closed/forward battery position, and FIGS. 2, 4, and 8 show the frame with an attached elongated slide with the action in the open/rear recoil position. FIGS. 5 and 6 show the frame removed from the pistol without an attached elongated slide.

The elongated slide 14 has opposed forward and rear ends 16, 18, a top 20, and a bottom 22. The top rear end of the elongated slide defines a rear sight dovetail slot 24. The forward end of the elongated slide defines an elongated slide passage 26 that receives a barrel 28. The barrel defines a muzzle aperture 30 and includes forward portion 32. The frame 12 has a forward frame and 34, a rear frame end 36, a top 38, a bottom 40, a left side 42, and a right side 44. The top of the frame includes forward slide rails 46 and rear slide rails 48. A left dust cover 50 extends upwardly from the left top of the frame, and a right dust cover 52 extends upwardly from the right top of the frame. The frame also includes a front sight support element 54 that extends upwardly from the top of the frame at the forward frame end. The front sight support element has a top 56 that defines a front sight dovetail slot 58. The front sight support element also defines an opening 60. The bottom rear of the frame has an attached grip 70.

The elongated slide 14 is connected to the frame 12 by the forward and rear slide rails 46, 48 and is operable to reciprocate on the top 38 of the frame between a closed/forward battery position and an open/rear recoil position. A rear sight 64 is connected proximate the rear end 18 of the elongated slide by way of a dovetail joint formed by the rear sight dovetail slot 24 receiving a lower portion 72 of the rear sight.

The forward frame end 34 is forward of the forward end 16 of the elongated slide 14 when the elongated slide is in the closed/forward battery position, which also makes the front sight support element 54 forward of the forward end of the elongated slide when the elongated slide is in the closed/forward battery position. The front sight support element includes a front sight 62 operably registered with the rear sight 64 when the elongated slide is in the closed/forward battery position. The front sight support element and front sight are connected by way of a dovetail joint formed by the front sight dovetail slot 58 receiving a lower portion 74 of the front sight. The front sight does not move when the elongated slide reciprocates, which enables the user to reacquire the target while the elongated slide is still reciprocating in recoil because the front sight is always in a fixed position relative to the frame 12. The front sight and rear sight are spaced apart by a first distance 66 shown in FIG. 3 when the elongated slide is in the closed/forward battery condition and by a greater second distance 70 shown in FIG. 4 when the elongated slide is in the open/rear recoil position.

The opening 60 defined by the front sight support element 54 is registered with the muzzle aperture 30 of the barrel 28. The forward portion 32 of the barrel is received within the opening of the front sight support element when the elongated slide 14 is in the open/rear recoil position. The barrel extends to the forward frame end 34 and is within the front sight support element when the elongated slide is in the closed/forward battery position. Thus, the barrel also extends forward of the forward end 16 of the elongated slide when the elongated slide is in the closed/forward battery position. As is shown in FIG. 8, the opening in the front sight support element is sized to permit the forward portion of the barrel to tilt upward when the action is in the open/rear recoil position with the rear 76 of the barrel having dropped by 1°. The barrel tilt enables a new cartridge (not shown) to be chambered in the rear of the barrel as the action returns to the closed/forward battery position shown in FIG. 7.

The left and right dust covers 50, 52 partially enclose the elongated slide 14 to protect the slide from foreign contaminants that could interfere with the elongated slide sliding smoothly along the forward and rear slide rails 46, 48 on the top 38 of the frame 12. The left and right dust covers also protect the elongated slide from interference from the user's appendages as well as other external physical elements such as clothing, branches, and walls. In the current embodiment, the tops 76, 78 of the left and right dust covers slope downwards as the tops approach the forward frame end 34. The tops of the left and right dust covers can be manufactured having any desired height or slope to produce the desired aesthetic effect.

It should be appreciated that the front sight support element is not integral with the forward frame end 34 in the current embodiment, but is instead attached to the forward frame end using any suitable approach such as fasteners (not shown). The front sight support element must be removable from the forward frame end in order to be able to disengage the elongated slide 14 from the forward and rear slide rails 46, 48 to disassemble the pistol 10. However, the front sight support element 54 could also be integral with the frame 12, making the front sight support element and the frame a unitary body in the current embodiment. The left and right dust covers 50, 52 are integral with the frame, making the left and right dust covers and the frame a unitary body. The frame 12 is wider and longer than a conventional pistol frame such that a standard elongated slide can be used in conjunction with the left and right dust covers and the front sight support element. The barrel 28 is also longer than a conventional barrel so it can be used in conjunction with the front sight support element. Alternatively, the elongated slide could be shortened and narrowed relative to a conventional elongated slide to accommodate the frame being of a standard length while retaining the features of the left and right dust covers and the front sight support element. This alternative approach could use a conventional length barrel.

It should also be appreciated that the left and right dust covers 50, 52 and the front sight support element 54 add additional weight to the forward frame end 34 to reduce undesirable muzzle rise during firearm operation that could increase the time required to reacquire the target.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pistol comprising: a frame having a grip;

an elongated slide connected to the frame and operable to reciprocate on the frame between a forward battery position and a rear position;

the elongated slide having opposed forward and rear ends;

a rear sight connected proximate the rear end of the elongated slide;

the frame including a front sight support element rigidly connected to the frame at a forward frame end, the entire front sight support element being forward of the forward end of the elongated slide when the elongated slide is in the forward battery position;

the front sight support element being spaced apart from the barrel and free of contact with the barrel;

the front sight support element defining a bore, and a forward portion of the barrel extending through the bore, the front sight support element including a front sight operably registered with the rear sight when the elongated slide is in the forward battery position, and wherein the frame has a dust cover portion entirely below the slide and having a forward end supporting the front sight support element, such that a connection between the front sight element and the slide is external to the pistol.

2. The pistol of claim 1 wherein the elongated slide defines a passage receiving a barrel defining a muzzle aperture, and wherein the front sight support element defines an opening registered with the muzzle aperture.

3. The pistol of claim 2 wherein a forward portion of the barrel is received within the opening of the front sight support element when the elongated slide is in the forward battery position.

4. The pistol of claim 2 wherein a forward portion of the barrel is received within the opening of the front sight support element when the elongated slide is in the rear position.

5. The pistol of claim 1 wherein the front sight support element and front sight are connected by way of a dovetail joint.

6. The pistol of claim 1 wherein the front sight and rear sight are spaced apart by a first distance when the elongated slide is in the forward battery condition and by a greater second distance when the elongated slide is in the rear position.

7. The pistol of claim 1 wherein the front sight does not move when the elongated slide reciprocates.

8. The pistol of claim 1 including a barrel extending to a forward end of the frame and within the front sight support element when the elongated slide is in the forward battery position.

9. The pistol of claim 1 including a barrel extending forward of the forward end of the elongated slide when the elongated slide is in the forward battery position.

* * * * *